US011155766B2

(12) United States Patent
Saito et al.

(10) Patent No.: US 11,155,766 B2
(45) Date of Patent: Oct. 26, 2021

(54) GREASE COMPOSITION

(71) Applicant: KYODO YUSHI CO., LTD., Fujisawa (JP)

(72) Inventors: Ryosuke Saito, Fujisawa (JP); Yuta Sato, Fujisawa (JP); Iwaki Hirooka, Fujisawa (JP)

(73) Assignee: KYODO YUSHI CO., LTD., Fujisawa (JP)

( * ) Notice: Subject to any disclaimer, the term of this patent is extended or adjusted under 35 U.S.C. 154(b) by 0 days.

(21) Appl. No.: 16/318,825

(22) PCT Filed: Jul. 26, 2017

(86) PCT No.: PCT/JP2017/026974
§ 371 (c)(1),
(2) Date: Jan. 18, 2019

(87) PCT Pub. No.: WO2018/021383
PCT Pub. Date: Feb. 1, 2018

(65) Prior Publication Data

US 2019/0185780 A1 Jun. 20, 2019

(30) Foreign Application Priority Data

Jul. 26, 2016 (JP) ..... JP2016-146280

(51) Int. Cl.

| | |
|---|---|
| ***C10M 169/00*** | (2006.01) |
| ***C10M 137/10*** | (2006.01) |
| ***C10M 129/74*** | (2006.01) |
| ***C10M 141/02*** | (2006.01) |
| ***C10M 129/32*** | (2006.01) |
| ***C10M 137/04*** | (2006.01) |
| ***C10M 129/40*** | (2006.01) |
| ***C10M 141/10*** | (2006.01) |
| *C10N 20/02* | (2006.01) |
| *C10N 30/10* | (2006.01) |
| *C10N 30/12* | (2006.01) |
| *C10N 40/02* | (2006.01) |
| *C10N 50/10* | (2006.01) |

(52) U.S. Cl.
CPC ..... *C10M 169/00* (2013.01); *C10M 129/32* (2013.01); *C10M 129/40* (2013.01); *C10M 129/74* (2013.01); *C10M 137/04* (2013.01); *C10M 137/10* (2013.01); *C10M 141/02* (2013.01); *C10M 141/10* (2013.01); *C10M 2205/0206* (2013.01); *C10M 2207/283* (2013.01); *C10M 2223/045* (2013.01); *C10M 2223/047* (2013.01); *C10N 2020/02* (2013.01); *C10N 2030/10* (2013.01); *C10N 2030/12* (2013.01); *C10N 2040/02* (2013.01); *C10N 2050/10* (2013.01)

(58) Field of Classification Search
CPC ..... C10M 169/00; C10M 129/74; C10M 141/02; C10M 141/10; C10M 137/10; C10M 2205/0206; C10M 2207/283; C10M 2223/045; C10M 2223/047; C10N 2040/02; C10N 2050/10
See application file for complete search history.

(56) References Cited

U.S. PATENT DOCUMENTS

| | | | | |
|---|---|---|---|---|
| 6,417,143 | B1 | 7/2002 | Mikami et al. | |
| 8,445,415 | B2 | 5/2013 | Mabuchi et al. | |
| 2002/0002119 | A1* | 1/2002 | Naka | C10M 105/34 508/379 |
| 2003/0081871 | A1* | 5/2003 | Fujita | G11B 19/2009 384/462 |
| 2004/0186025 | A1* | 9/2004 | Nakatani | C10M 119/22 508/130 |
| 2008/0271967 | A1 | 11/2008 | Nakatani et al. | |
| 2009/0003742 | A1* | 1/2009 | Nakatani | C10M 169/04 384/289 |
| 2009/0136170 | A1 | 5/2009 | Sato et al. | |
| 2011/0160105 | A1 | 6/2011 | Tanaka et al. | |
| 2013/0310292 | A1 | 11/2013 | Yamamoto et al. | |
| 2013/0331306 | A1 | 12/2013 | Aida et al. | |
| 2014/0205226 | A1 | 7/2014 | Sonoda et al. | |
| 2015/0299610 | A1* | 10/2015 | Ohyama | F16C 33/6633 508/437 |
| 2016/0177213 | A1* | 6/2016 | Yoshinari | C10M 135/36 508/271 |
| 2017/0275558 | A1 | 9/2017 | Saito et al. | |

FOREIGN PATENT DOCUMENTS

| | | | |
|---|---|---|---|
| CN | 101273117 | A | 9/2008 |
| CN | 103403137 | A | 11/2013 |
| EP | 3018192 | A1 | 5/2016 |
| JP | H04178499 | A | 6/1992 |
| JP | H11131084 | A | 5/1999 |
| JP | 2000198993 | A | 7/2000 |
| JP | 2012172066 | A | 9/2012 |
| JP | 2012197401 | A | 10/2012 |
| JP | 2016050234 | A | 4/2016 |
| JP | 2016089040 | A | 5/2016 |
| WO | 2007037308 | A1 | 4/2007 |

OTHER PUBLICATIONS

International Search Report (with English translation) and Written Opinion issued in corresponding International Patent Application No. PCT/ JP2017/026974, 14 pages, dated Aug. 22, 2017.
Notification of Reason for Refusal dated Dec. 24, 2019, by the Korean Patent Office in corresponding Korean Patent Application No. 10-2019-7003297 and an English translation of the Notification. (11 pages).

(Continued)

*Primary Examiner* — Ellen M McAvoy
(74) *Attorney, Agent, or Firm* — Buchanan Ingersoll & Rooney PC

(57) ABSTRACT

A grease composition comprises a thickener, a base oil, and a friction modifier. The friction modifier comprises: at least one selected from the group consisting of fatty acids, fatty acid metal salts, phosphate esters, thiophosphate esters, and zinc dithiophosphates; and a polyhydric alcohol ester.

8 Claims, No Drawings

(56) References Cited

OTHER PUBLICATIONS

The partial supplementary European search report dated Feb. 3, 2020, by the European Patent Office in corresponding European Patent Application No. 17834385.1. (11 pages).
Ren Hai, et al., "Installation and Repair of Building Materials Machinery", Wuhan University of Technology Press, Sep. 2013, p. 67, and an English translation. (4 pages).
First Office Action dated Feb. 3, 2021, by the State Intellectual Property Office of the People's Republic of China in corresponding Chinese Patent Application No. 201780046083.X, and an English translation of the Office Action. (12 pages).
Second Notice of Examination Opinion dated Jul. 21, 2021, by the State Intellectual Property Office of the People's Republic of China in corresponding Chinese Patent Application No. 201780046083.X and an English translation of the Notice. (9 pages).
Communication pursuant to Article 94(3) EPC dated Aug. 3, 2021, by the European Patent Office in corresponding European Patent Application No. 17834385.1. (4 pages).
Zhong, Dong, "Automotive lubricants", China Communications Press, Jul. 1986, pp. 228-229, with an English translation.
Nukada et al., "Mechanical reliability and failure analysis", National Defense Industry Press, Apr. 2006 (The first edition), p. 228, with an English translation.

* cited by examiner

GREASE COMPOSITION

TECHNICAL FIELD

The present invention relates to a grease composition suitable for use in a rolling bearing, particularly a four-point contact bearing.

BACKGROUND ART

In recent years, from the viewpoint of energy consumption reduction, mechanical parts used in various industries have been required to achieve higher efficiency, and have been studied in various aspects such as weight reduction and size reduction of the parts, and structural improvement. However, with the size reduction of the parts, there arises a problem in that the torque of a bearing increases in the rolling and rolling sliding motions like a case where a speed difference in rotational fluctuations increases so much that not only a rolling motion but also a rolling sliding motion occurs, and a case where load on a mechanical part including a rotating body is increased to enhance transmission efficiency.

From the viewpoint of the size reduction of parts, use of four-point contact bearings in place of conventional double row angular contact ball bearings is promoted in applications where axial load is applied from both directions. The four-point contact bearing is characterized by having an ability to receive the axial load from both directions even though the primary dimensions thereof are comparable to those of a single row ball bearing. The four-point contact bearing is generally used in a two-point contact state under use conditions where pure axial load or axial load is high. Moreover, when the internal gap in the axial direction is set to a negative value (that is, a condition where a preload is applied), the four-point contact bearing can suppress the occurrence of noise and unpleasant vibration due to the internal clearance. Hence, the four-point contact bearing can be also applied to parts required to achieve high precision.

However, under use conditions where radial load is high relative to the axial load or under use conditions where the rolling speed is very low, there is a problem in that a large sliding motion occurs at the contact portions due to a transition from a two-point contact state to a four-point contact state, with the results of an increase in the torque and the occurrence of a stick-slip phenomenon.

As conventional methods of reducing the torque of the rolling bearing, there are a method of decreasing the kinematic viscosity of a base oil as much as possible to reduce the rolling viscous resistance, a method of decreasing the apparent viscosity of a grease to reduce the stirring resistance, and a method of reducing the amount of the grease used in mechanical members. For example, Patent Literature 1 proposes a grease composition using a base oil containing an ester oil having a kinematic viscosity at 40° C. of 10 $mm^2/s$ or more. For example, Patent Literature 2 proposes a grease composition using an alicyclic aliphatic diurea as a thickener for lowering stirring resistance.

However, the methods described above cannot suppress an increase in the torque due to a sliding motion. The bearings disclosed in Patent Literatures 1 and 2 are not four-point contact bearings.

CITATION LIST

Patent Literatures

Patent Literature 1: Japanese Patent Application Publication No. 2000-198993

Patent Literature 2: Japanese Patent Application Publication No. 2012-172066

SUMMARY OF INVENTION

Problems to be Solved by the Invention

Under the above circumstance, a problem to be solved by the present invention is to provide a grease composition capable of effectively reducing torque.

Means for Solution of the Problems

The present inventors solved the above problem by selecting appropriate additives. Specifically, the present invention provides the following grease compositions.

1. A grease composition comprising a thickener, a base oil, and a friction modifier, wherein the friction modifier comprises at least one selected from the group consisting of fatty acids, fatty acid metal salts, phosphate esters, thiophosphate esters, and zinc dithiophosphates; and a polyhydric alcohol ester.
2. The grease composition according to the above 1, wherein the friction modifier comprises a phosphate ester and the polyhydric alcohol ester.
3. The grease composition according to the above 1 or 2, wherein the phosphate ester is at least one selected from the group consisting of phosphite esters, acidic phosphate esters, and amine salts of acidic phosphate esters.
4. The grease composition according to any one of the above 1 to 3, wherein the grease composition is for a rolling bearing.
5. The grease composition according to the above 4, wherein the rolling bearing is a bearing which performs a rolling sliding motion.
6. The grease composition according to the above 4 or 5, wherein the rolling bearing is a four-point contact bearing.

Advantageous Effects of Invention

With the grease composition of the present invention, the torque can be efficiently reduced. When the grease composition of the present invention is applied to a rolling bearing which performs a rolling sliding motion, the friction in sliding of the bearing can be reduced.

DESCRIPTION OF EMBODIMENTS

[Thickener]

As a thickener usable in the present invention, there are: soap thickeners typified by lithium soaps and lithium complex soaps; urea thickeners typified by diurea, inorganic thickeners typified by organically modified clay and silica; organic thickeners typified by PTFE; and the like.

A preferable one is a soap thickener, and a more preferable one is a lithium soap or a lithium complex soap. As the lithium soap, a lithium stearate or a lithium 12-hydroxystearate is preferable and the lithium 12-hydroxystearate is more preferable. As the lithium complex soap, a complex of a lithium salt of an aliphatic carboxylic acid such as stearic acid or 12-hydroxystearic acid and a lithium salt of a dibasic acid or the like is preferable. As the dibasic acid, succinic acid, malonic acid, adipic acid, pimelic acid, azelaic acid, sebacic acid, and the like are preferable, and the azelaic acid and the sebacic acid are more preferable. A particularly preferable one is a lithium complex soap that is a mixture of a salt of azelaic acid and lithium hydroxide and a salt of 12-hydroxystearic acid and lithium hydroxide.

The lithium soap and the lithium complex soap have good lubricity and therefore produce a high torque reduction effect especially under a rolling sliding environment in which large sliding occurs. In addition, the lithium soap and the lithium complex soap are thickeners having practicality because they have few drawbacks and are inexpensive. Moreover, the lithium complex soap is excellent in heat resistance and accordingly is also excellent in lifetime even under a high temperature environment.

A content of the thickener is preferably 3 to 20% by mass and more preferably 5 to 15% by mass with respect to the mass of the grease composition of the present invention. If the content of the thickener is within the above range, the grease has moderate consistency to rarely cause leakage and also has excellent low temperature properties owing to favorable flowability.

[Base Oil]

A base oil usable in the present invention is not limited to a particular one. Mineral oil, synthetic oil, or a mixture thereof can be used. As the synthetic oil, there are various synthetic oils such as: ester synthetic oils typified by diesters and polyol esters; synthetic hydrocarbon oils typified by poly α-olefin and polybutene; ether synthetic oils typified by alkyl diphenyl ether and polypropylene glycol; silicone oils; and fluorinated oils.

As the base oil of the present invention, the mineral oil, the poly α-olefin, the polyol ester, or the alkyl diphenyl ether is preferable, and the polyol ester or the alkyl diphenyl ether is more preferable. The poly α-olefin is particularly preferable.

A content of the base oil is preferably at least 50% by mass with respect to the total mass of the grease composition of the present invention. The content of the base oil is more preferably 80 to 90% by mass, and further preferably 85 to 90% by mass.

A kinematic viscosity of the base oil at 40° C. is not particularly limited but is preferably 15 to 200 $mm^2/s$. The kinematic viscosity is more preferably 30 to 100 $mm^2/s$ and particularly preferably 40 to 80 $mm^2/s$. If the kinematic viscosity of the base oil at 40° C. is within the above range, the grease can have favorable heat resistance while achieving satisfactory low-temperature flowability.

[Friction Modifier]

A friction modifier of the present invention comprises a combination of at least one selected from fatty acids, fatty acid metal salts, phosphate esters, thiophosphate esters, and zinc dithiophosphates with a polyhydric alcohol ester.

Examples of the fatty acids include: saturated fatty acids such as butyric acid, valeric acid, caproic acid, heptylic acid, caprylic acid, pelargonic acid, capric acid, lauric acid, myristic acid, pentadecylic acid, palmitic acid, margaric acid, stearic acid, arachidic acid, heneicosylic acid, behenic acid, lignoceric acid, cerotic acid, montanic acid, and melissic acid; unsaturated fatty acids such as crotonic acid, myristoleic acid, palmitoleic acid, sapenoic acid, oleic acid, elaidic acid, vaccenic acid, gadoleic acid, eicosenoic acid, erucic acid, carboxylic acid, linoleic acid, eicosadienoic acid, docosadienoic acid, linolenic acid, pinolenic acid, eleostearic acid, meadic acid, dihomo-γ-linolenic acid, eicosatrienoic acid, stearidonic acid, arachidonic acid, eicosatetraenoic acid, adrenic acid, bosseopentaenoic acid, eicosapentaenoic acid, osbondic acid, sardine acid, tetracosapentaenoic acid, docosahexaenoic acid, and nisinic acid; and mixtures thereof. As the fatty acid, the caprylic acid, the capric acid, the lauric acid, the myristyrinic acid, the palmitic acid, the stearic acid, the oleic acid, or the linoleic acid is preferable, and the oleic acid is more preferable.

Examples of the fatty acid metal salts include metal soaps of fatty acids having preferably 6 to 24 carbon atoms and more preferably 12 to 18 carbon atoms, and mixtures thereof. Preferable specific examples of the fatty acids include stearic acid, palmitic acid, and the like. The metal soaps include soaps of alkali metals such as sodium and potassium, soaps of alkaline earth metals such as magnesium and calcium, zinc soaps, aluminum soaps, lithium soaps, and mixtures thereof. As the fatty acid metal salt, a metal soap of stearic acid is preferable, and a lithium soap of stearic acid is particularly preferable.

Examples of the phosphate esters include phosphate esters, phosphite esters, hypophosphite esters, amine salts of acidic phosphate esters, amine salts of acidic phosphite esters, amine salts of acidic hypophosphite esters, and mixtures thereof.

As the phosphate ester, a phosphate ester, a phosphite ester, an acidic phosphate ester, or an amine salts of acidic phosphate ester is preferable. Tricresyl phosphate (TCP) or trioctyl phosphate (TOP) is more preferable.

As the phosphite ester, triphenyl phosphite or triethyl phosphite is preferable.

As the acidic phosphate ester, diphenyl hydrogen phosphite or diethyl hydrogen phosphite is preferable.

As the amine salt of acidic phosphate ester, preferable is an amine salt of a compound in which an acidic phosphate ester is represented by the formula (1):

$$R^{15}O_APO(OH)_{3-A} \quad (1)$$

(where $R^{15}$ represents a linear or branched alkyl group having 1 to 30 carbon atoms, preferably a linear or branched alkyl group having 1 to 18 carbon atoms, more preferably an alkyl group having 1 to 8 carbon atoms, and particularly preferably an alkyl group having 1 to 4 carbon atoms, and A represents 1 or 2, and preferably 2). As the amine salt of acidic phosphate ester, tertiary alkylamine-dimethyl phosphate is preferable in particular.

As the thiophosphate ester, there are ethyl-3-[[bis(1-methylethoxy) phosphinothioyl]thio]propionate, a mixture of a triphenylthiophosphate ester and a tert-butylphenyl derivative, 3-(di-isobutoxy-thiophosphoryl sulfanyl)-2-methyl-propionic acid, tris[(2 or 4)-isoalkylphenol]thiophosphate, and triphenyl phosphorothionate. As the thiophosphate ester, triphenyl phosphorothionate is preferable.

As the zinc dithiophosphate, zinc dibutyl dithiophosphate, zinc dipentyl dithiophosphate, zinc dihexyl dithiophosphate, zinc diheptyl dithiophosphate, zinc dioctyl dithiophosphate, zinc dinonyl dithiophosphate, zinc didecyl dithiophosphate, zinc diundecyl dithiophosphate, zinc didodecyl dithiophosphate, zinc dibutyl dithiophosphate sulfide, zinc dipentyl dithiophosphate sulfide, zinc dihexyl dithiophosphate sulfide, zinc diheptyl dithiophosphate sulfide, zinc dioctyl dithiophosphate sulfide, zinc dinonyl dithiophosphate sulfide, zinc didecyl dithiophosphate sulfide, zinc diundecyl dithiophosphate sulfide, zinc dideodecyl dithiophosphate sulfide, mixtures thereof, and the like. As the zinc dithiophosphate, a mixture of zinc dibutyl dithiophosphate and zinc dipentyl dithiophosphate is preferable.

As the friction modifier of polyhydric alcohol ester, there are glycerin fatty acid esters and sorbitan fatty acid esters such as sorbitan trioleate and sorbitan monooleate. As the friction modifier of polyhydric alcohol ester, the sorbitan trioleate or the sorbitan monooleate is preferable, and the sorbitan trioleate is more preferable.

As the friction modifier of the present invention, it is preferable to use a combination of a phosphate ester and a polyhydric alcohol ester. Moreover, it is also preferable that the friction modifier of the present invention comprise only a combination of at least one selected from fatty acids, fatty acid metal salts, phosphate esters, thiophosphate esters, and zinc dithiophosphates with a polyhydric alcohol ester. It is more preferable that the friction modifier of the present invention comprise a phosphate ester and a polyhydric alcohol ester. More preferable combinations each contain: a phosphate ester which is at least one selected from the group consisting of phosphite esters, acidic phosphate esters, and amine salts of acidic phosphate esters; and a polyhydric alcohol ester. Among these, a combination of at least one selected from the group consisting of oleic acid, tertiary alkylamine-dimethyl phosphate, triphenyl phosphorothioate, and zinc dialkyl dithiophosphate with a sorbitan trioleate is preferable. In particular, a combination of tertiary alkyl amine-dimethyl phosphate and sorbitan trioleate is preferable.

A content of the friction modifier of the present invention is preferably 0.2 to 10% by mass, more preferably 0.5 to 5% by mass, and further preferably 1 to 3% by mass with respect to the total mass of the grease composition of the present invention. If the grease composition of the present invention contains a friction modifier other than the friction modifiers specified above, the content of the friction modifier specified in the present application is preferably 5 parts by mass relative to 100 parts by mass of the friction modifiers.

[Additive]

The grease composition of the present invention may comprise an additive generally used in various kinds of lubricants and greases in addition to the friction modifier. As such additives, there are antioxidants, rust inhibitors, load-bearing additives, metal corrosion inhibitors, oiliness agents, solid lubricants, other friction modifiers, and so on. Among them, an antioxidant, a rust inhibitor, or a metal corrosion inhibitor is preferably contained.

A content of these optional additives is usually 0.2 to 25% by mass with respect to the total mass of the grease composition of the present invention.

As the antioxidant, there are amine antioxidants, phenolic antioxidants, and the like.

As the amine antioxidants, there are N-n-butyl-p-aminophenol, 4,4'-tetramethyl-di-aminodiphenylmethane, α-naphthylamine, N-phenyl-α-naphthylamine, phenothiazine, alkyldiphenylamine, and the like. Among them, the alkyldiphenylamine is preferable.

As the phenolic antioxidants, there are 2,6-di-tertiary butyl-p-cresol (BHT), 2,2'-methylenebis(4-methyl-6-tertiary butylphenol), 4,4'-butylidenebis(3-methyl-6-tertiary butylphenol), 2,6-di-tertiary butyl-phenol, 2,4-dimethyl-6-tertiary butylphenol, tertiary butylhydroxyanisole (BHA), 4,4'-butylidenebis(3-methyl-6-tertiary butylphenol), 4,4'-methylenebis(2,3-di-tertiary butylphenol), 4,4'-thiobis(3-methyl-6-tertiary butylphenol), octadecyl-3-(3,5-di-t-butyl-4-hydroxyphenyl) propionate, and the like. Among these, the octadecyl-3-(3,5-di-t-butyl-4-hydroxyphenyl)propionate is preferable.

As the antioxidant, it is preferable to contain an amine antioxidant and a phenolic antioxidant. It is particularly preferable to contain alkyl diphenylamine and octadecyl-3-(3,5-di-t-butyl-4-hydroxyphenyl)propionate.

A content of the antioxidant is preferably 0.5 to 6% by mass with respect to the total mass of the grease composition of the present invention.

As the rust inhibitors, there are inorganic rust inhibitors and organic rust inhibitors. As the inorganic rust inhibitors, there are inorganic metal salts such as Na silicate, Li carbonate, K carbonate and Zn oxide. The zinc oxide is preferable. As the organic rust inhibitors, there are organic sulfonates including zinc sulfonate and Ca sulfonate; benzoates including Na benzoate and Li benzoate; carboxylates such as Na sebacate; succinic acid derivatives including succinic acid, succinic acid anhydride, and succinic acid half esters; sorbitan esters such as sorbitan monooleate and sorbitan trioleate; fatty acid amine salts each containing a saturated or unsaturated fatty acid having 4 to 22 carbon atoms or preferably a saturated or unsaturated fatty acids having 8 to 18 carbon atoms, and a saturated or unsaturated amine having 1 to 42 carbon atoms or preferably a saturated or unsaturated amine having 4 to 22 carbon atoms; and the like. The succinic acid derivative, the organic sulfonate, and the fatty acid amine salt are preferable, and the succinic acid half ester, the zinc sulfonate (particularly, zinc dinonylnaphthalene sulfonate), and a mixture containing a salt of a fatty acid having 8 carbon atoms and an amine having 12 carbon atoms, and a salt of a fatty acid having 18 carbon atoms and an (mixed) amine having 12 to 20 carbon atoms are preferable in particular.

A content of the rust inhibitor is preferably 0.2 to 10% by mass with respect to the total mass of the grease composition of the present invention.

As the metal deactivators, there are triazole compounds such as benzotriazole, benzimidazole, indole, and methylbenzotriazole. Among them, the benzotriazole is more preferable.

A content of the metal deactivator is preferably 0.01 to 5% by mass with respect to the total mass of the grease composition of the present invention.

[Worked Penetration]

The worked penetration of the grease composition of the present invention after 60 strokes is preferably 200 to 350. If the worked penetration is within this range, the grease composition can satisfy lubrication life by achieving a reduction in leakage due to high-speed rotation, and on the other hand also can satisfy the lubrication life by achieving favorable flowability of the grease.

[Bearing]

A bearing to be filled with the grease composition of the present invention is preferably a rolling bearing which performs a rolling sliding motion. A rolling bearing which performs a rolling sliding motion with large sliding is preferable, and a preferable type is a four-point contact bearing.

EXAMPLES

Preparation of Test Greases

As a grease composition containing a lithium soap as a thickener, a grease was prepared in such a way that: a base grease was obtained by adding 12-hydroxystearic acid to a base oil, heating the obtained mixture, adding an aqueous lithium hydroxide solution to the mixture, heating the obtained mixture again, and then quickly cooling the mixture; and the base oil and additives were added to the base grease, followed by milling processing to obtain a worked penetration of 300 (JIS K2220, the worked penetration after 60 strokes).

As each grease composition containing a lithium complex soap as a thickener, a grease was prepared in such a way that: a base grease was obtained by adding azelaic acid and 12-hydroxystearic acid to a base oil, heating the obtained mixture, adding an aqueous lithium hydroxide solution to the mixture, heating the obtained mixture again, and then quickly cooling the mixture; and the base oil and additives were added to the base grease, followed by milling processing to obtain a worked penetration of 300 (JIS K2220, the worked penetration after 60 strokes).

<Thickener>

Lithium soap . . . A soap synthesized from 12-hydroxystearic acid and lithium hydroxide.

Lithium complex soap . . . A complex soap synthesized from azelaic acid, 12-hydroxystearic acid, and lithium hydroxide.

<Base Oil>

Poly α-olefin (the kinematic viscosity: 48.5 $mm^2/s$ at 40° C.)

The kinematic viscosity of the base oil at 40° C. was measured in accordance with JIS K 2220 23.

<Friction Modifier>

Fatty acid . . . Oleic acid (LUNAC O-P, manufactured by Kao Corporation)

Fatty acid metal salt . . . Lithium stearate (manufactured by KATSUTA KAKO CO., LTD.)

Phosphate ester . . . Tertiary alkylamine-dimethyl phosphate (Vanlube 672, manufactured by R. T. Vanderbilt Company, Inc.)

Thiophosphate ester . . . Triphenyl phosphorothioate (IRGALUBE TPPT, manufactured by BASF SE)

Zinc dithiophosphate . . . Zinc dialkyl dithiophosphate (Lubrizol 1395, manufactured by Lubrizol Corporation)

Polyhydric alcohol ester . . . Sorbitan trioleate (NONION OP-85R, manufactured by NOF CORPORATION)

<Other Additives>

Amine antioxidant (Alkyldiphenylamine)

Phenolic antioxidant (Octadecyl-3-(3,5-di-t-butyl-4-hydroxyphenyl)propionate)

Alkenyl succinic anhydride (Rust inhibitor)

Benzotriazole (Metal deactivator)

<Test Method>

Bearing Torque Test

This test is a test to evaluate the bearing torque. A rolling bearing was operated under the following conditions, and the torque was measured by bringing a bar attached to a housing of the bearing into contact with a load cell fixed to a stand.

Bearing type: QJ205 (four-point contact bearing)

Test temperature: 25° C.

Rotation speed: 1 rpm

Test load: Radial load of 500 N and axial load of 50 N

Evaluation: A bearing torque reduction rate was expressed by a value based on the measured value of Comparative Example 4.

The results are shown in Table 1 and Table 2.

TABLE 1

| | | Ex. 1 | Ex. 2 | Ex. 3 | Ex. 4 | Ex. 5 | Ex. 6 | Ex. 7 | Ex. 8 |
|---|---|---|---|---|---|---|---|---|---|
| Thickener | Lithium soap | | | | | | | 10.0 | |
| % by mass | Lithium complex soap | 11.0 | 11.0 | 11.0 | 11.0 | 11.0 | 11.0 | | 11.0 |
| Base oil | Poly α-olefin | Balance | Balance | Balance | Balance | Balance | Balance | Balance | Balance |
| % by mass | | | | | | | | | |
| Friction | Fatty acid | 1.0 | | | | | | | 1.0 |
| modifier | Fatty acid metal salt | | 1.0 | | | | | | |
| % by mass | Phosphate ester | | | 1.0 | | | 0.2 | 0.2 | |
| | Thiophosphate ester | | | | 1.0 | | | | |
| | Zinc dithiophosphate | | | | | 1.0 | | | |
| | Polyhydric alcohol ester | 1.0 | 1.0 | 1.0 | 1.0 | 1.0 | 1.0 | 1.0 | 1.0 |
| Other additives* | | Added | Added | Added | Added | Added | Added | Added | |
| Penetration | | 300 | 300 | 300 | 300 | 300 | 300 | 300 | 300 |
| Bearing Torque mN · m | | 17.7 | 18.2 | 16.5 | 19.2 | 17.2 | 15.9 | 16.2 | 18.3 |
| Bearing torque reduction rate % | | 32 | 31 | 37 | 27 | 34 | 39 | 38 | 30 |

*Amine antioxidant (2% by mass), phenolic antioxidant (1% by mass), and alkenyl succinic anhydride (0.5% by mass)

TABLE 2

| | | Comp. Ex. 1 | Comp. Ex. 2 | Comp. Ex. 3 | Comp. Ex. 4 |
|---|---|---|---|---|---|
| Thickener | Lithium soap | | | | |
| % by mass | Lithium complex soap | 11.0 | 11.0 | 11.0 | 11.0 |
| Base oil % by mass | Poly α-olefin | Balance | Balance | Balance | Balance |
| Friction modifier | Fatty acid | | | | |
| % by mass | Fatty acid metal salt | | | | |
| | Phosphate ester | | | | |
| | Thiophosphate ester | | | | |
| | Zinc dithiophosphate | | | | |
| | Polyhydric alcohol ester | | 1.0 | 1.0 | |
| | Polyethylene wax | | 1.0 | | |
| | Calcium carbonate | | | 1.0 | |
| Other additives* | | Added | Added | Added | |
| Penetration | | 300 | 300 | 300 | 300 |
| Bearing Torque mN · m | | 25.7 | 27.5 | 28.6 | 26.2 |
| Bearing torque reduction rate % | | 2 | −5 | −9 | Reference |

*Amine antioxidant (2% by mass), phenolic antioxidant (1% by mass), and alkenyl succinic anhydride (0.5% by mass)

What is claimed is:

1. A grease composition comprising 3 to 20% by mass of a thickener, a base oil, and 0.5 to 5% by mass of a friction modifier, wherein the thickener is lithium soap, lithium complex soap or urea thickener, the base oil is poly α-olefin, and the friction modifier comprises:

a tertiary alkylamine-dimethyl phosphate, and sorbitan trioleate, all percentages by mass are based on a total mass of the grease composition.

2. The grease composition according to claim 1, wherein the grease composition is for a rolling bearing.

3. The grease composition according to claim 2, wherein the rolling bearing is a bearing which performs a rolling sliding motion.

4. The grease composition according to claim 2, wherein the rolling bearing is a four-point contact bearing.

5. The grease composition according to claim 1, wherein the base oil is present in an amount of 50 to 90% by mass with respect to the total mass of the composition.

6. The grease composition according to claim 1, wherein the base oil has a kinematic viscosity at 40° C. of 15 to 200 $mm^2/s$.

7. The grease composition according to claim 1, further comprising additives selected from the group consisting of an antioxidant, a rust inhibitor, and a metal corrosion inhibitor.

8. The grease composition according to claim 7, wherein the additives are present in an amount of 0.2 to 25% by mass with respect to the total mass of the composition.

* * * * *